United States Patent [19]

Scott

[11] 4,123,874

[45] Nov. 7, 1978

[54] BY-PASS DOOR ASSEMBLY

[75] Inventor: Victor J. Scott, Spring Lake, Mich.

[73] Assignee: Leigh Products, Inc., Coopersville, Mich.

[21] Appl. No.: 764,344

[22] Filed: Jan. 31, 1977

[51] Int. Cl.[2] ..... E05D 13/02

[52] U.S. Cl. ..... 49/411; 49/425; 52/720; 52/823

[58] Field of Search ..... 49/411, 410, 425, 501; 52/624, 627, 628, 720, 721, 716–718

[56] References Cited

U.S. PATENT DOCUMENTS

| | | | |
|---|---|---|---|
| 25,413 | 4/1896 | Jones | 52/720 X |
| 25,414 | 4/1896 | Jones | 52/720 X |
| 3,058,173 | 10/1962 | Brydolf | 49/411 |
| 3,294,353 | 12/1966 | Rowe | 52/627 X |
| 3,382,614 | 5/1968 | Adell | 52/627 X |
| 3,650,071 | 3/1972 | Tanner | 49/411 |
| 3,701,179 | 10/1972 | Cox | 49/411 X |
| 3,744,827 | 7/1973 | Cox | 49/411 X |
| 3,750,337 | 8/1973 | Brydolf et al. | 49/411 |
| 3,766,700 | 10/1973 | Nuss | 52/624 |
| 3,879,912 | 4/1975 | Cox | 49/411 X |

*Primary Examiner*—Philip C. Kannan

*Attorney, Agent, or Firm*—Price, Heneveld, Huizenga & Cooper

[57] ABSTRACT

A by-pass door assembly is disclosed including a pair of stiles and a pair of trim pieces adapted to frame a rectangular panel and a plurality of corner brackets held by the stiles and the trim pieces. Each of the stiles includes an elongated one-piece slot free member having spaced front and rear walls joined by a side wall to define a panel receiving channel. The rear wall and the side wall define a triangular box shaped portion. Each of the trim pieces includes a rear wall having a longitudinally extending, outwardly directed groove portion. Each of the corner brackets includes a central, channel-shaped housing and outwardly extending portions having spaced tabs adapted to be received and captured by the stile members. Tabs extend outwardly from the transverse edge of the bracket and include a transverse bead which is captured by the groove of the trim member. Brackets on one side of the panel are adapted to retain guide rollers to either suspend the door construction from an upper track or to support the door construction on the lower track. The remaining corner brackets carry guide members having flexible attachment tabs.

28 Claims, 15 Drawing Figures

BY-PASS DOOR ASSEMBLY

BACKGROUND OF THE INVENTION

This invention relates to door closures and more particularly to hardware for a by-pass type sliding door construction.

Various forms of sliding door or by-pass door constructions have been proposed. These doors include a pair of rectangular panels which are mounted in a doorway for sliding movement relative to each other. The hardware for such by-pass doors typically includes upper and lower trim members and side stile members, each of the members being adapted to receive an edge of the rigid panel to thereby frame the panel. Corner brackets, either by fasteners or by slots and connecting lugs or tang arrangements, are connected to the trim and stile members. The corner brackets help in rigidifying the door construction and connect the stiles and trim members. In a typical top roller by-pass door, the upper corner brackets will carry screw adjustable roller assemblies. The roller assemblies include rollers which ride within an upper track secured to the door header. The lower brackets carry guide members which are adapted to ride within a lower track so as to guide the doors and to prevent inadvertent removal of the doors from the tracks.

When the rectangular panel framed by the stile and trim members is of a relatively heavy construction such as when the rectangular panel is a mirrored panel, bottom roller configurations are preferred since they are better able to support the increased weight. For these latter arrangements, the positioning of the rollers and the guides is usually reversed.

Examples of such previous by-pass or sliding door constructions may be found in U.S. Pat. No. 3,879,912, entitled HARDWARE FOR A SLIDING DOOR INSTALLATION, issued Apr. 29, 1975, to Cox; U.S. Pat. No. 3,750,337, entitled SLIDING DOOR CORNER CONNECTOR, issued Aug. 7, 1973 to Brydolf et al; U.S. Pat. No. 3,650,071, entitled PANEL FRAME ASSEMBLY, issued Mar. 21, 1972 to Tanner; U.S. Pat. No. 3,562,956, entitled SLIDING DOOR FRAME, issued Feb. 16, 1971 to Johnson, Jr.; and U.S. Pat. No. 3,261,129, entitled PANEL HARDWARE, issued July 19, 1966 to Brydolf et al.

The prior art arrangements exemplified by these aforementioned patents typically employ fasteners to secure the stiles, the trim members and the corner brackets to each other and to the panels, or in the alternative, they employ slots and cooperating lugs or tangs on the brackets and/or stile or trim members to interconnect the sliding door hardware. The constructions noted above employing lugs and slots present difficulty in adapting the hardware to doors of varying sizes. Individuals installing doors of this type by themselves without the help of professional installers have problems adapting the doors and installing them in nonstandard openings. The particular size door opening may not be dimensioned in accordance with the standard stile and trim member dimensions offered by a manufacturer. In such instances, snap together sliding door hardware employing slots and lug or tab interconnections must be reworked with new slots formed in the members. Such reworking is not always easily accomplished and requires special tools normally not available to the installer, particularly the do-it-yourself installer.

It is highly desirable for the sliding door hardware to readily adapt to and frame panels of varying thickness. The sliding door installations should be readily and easily adjusted between the upper and lower tracks to insure proper operation without the need for using hand tools. The stile and trim members besides serving to frame the panel and support the corner brackets should also substantially increase the rigidity of the panel and overall door construction from that provided by the panel alone.

A need exists for a by-pass door assembly employing completely snap together hardware readily modified for doors of smaller dimension than that provided by the standard size stile and trim members, which is easily manufactured, which is aesthetically pleasing and which is readily and easily adjusted for proper operation without the use of hand tools.

SUMMARY OF THE INVENTION

In accordance with the present invention, improved stiles, trim pieces, corner brackets, rollers and guide members are provided by which the problems heretofore experienced are substantially alleviated. Essentially, the stiles which frame the vertical edges of a central panel are fabricated as elongated members each defining a panel receiving channel and including a front wall, a side wall and a rear wall. The front wall includes a reverse bent portion terminating in a sharp edge positioned within the channel. The rear wall and the side wall define a triangular box portion which substantially increases the rigidity of the stile and reduces the amount of material necessary for such a rigid stile construction. The rear wall of the stile also includes a reverse bent portion angled towards the front wall and the side wall. The stile channel is adapted to receive a wide range of panel sizes which preventing cocking or twisting of the stile on the panel during installation.

Each of the corner brackets are non-handed and includes a central channel-shaped housing portion having a longitudinal slot therein for adjustably receiving a roller or a guide means. The brackets include outwardly extending portions having tabs thereon which are received under the reverse bent portions of the rear walls of the stiles. Extending from a transverse edge of the bracket is an L-shaped member having a bead therein. The bead is adapted to cooperate with the corresponding, longitudinally extending groove formed in the trim members. The trim members snap over the L-shaped lugs and capture the bead within the grooves.

The stiles and trim members are slot free and do not require fasteners for securement. The members are readily adapted to odd-size doors by merely straight cutting the members to the proper dimension. Provision is made for attaching the guides to the brackets so that they may be removed from the brackets once the door is installed for replacement without disassembly of the door.

DETAILED DESCRIPTION OF THE PREFERRED EMBODIMENT

Figure 1:
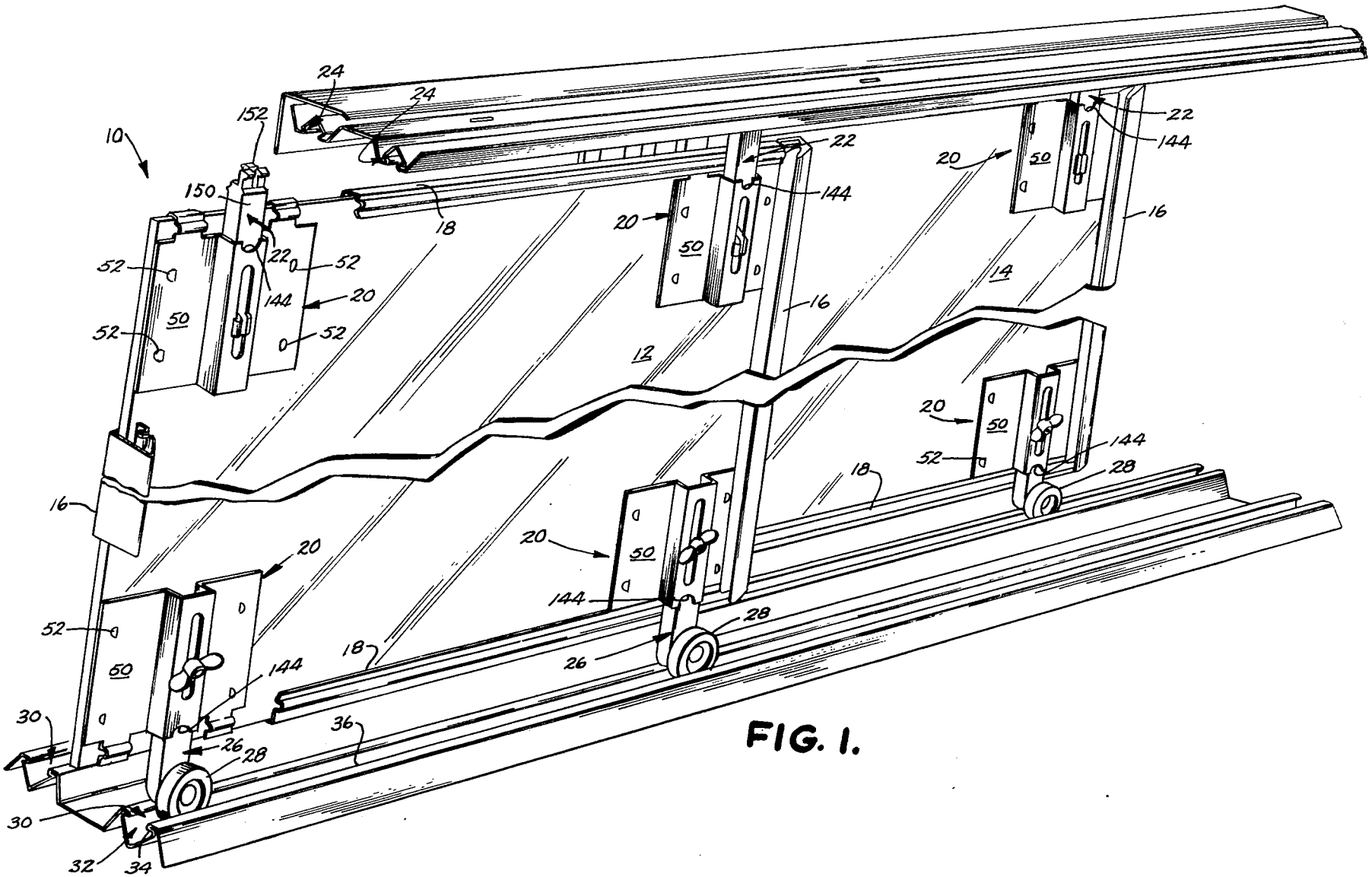
FIG. 1 is a fragmentary, partially sectioned, perspective view of a bottom roller by-pass door assembly in accordance with the present invention.
Figure 2:
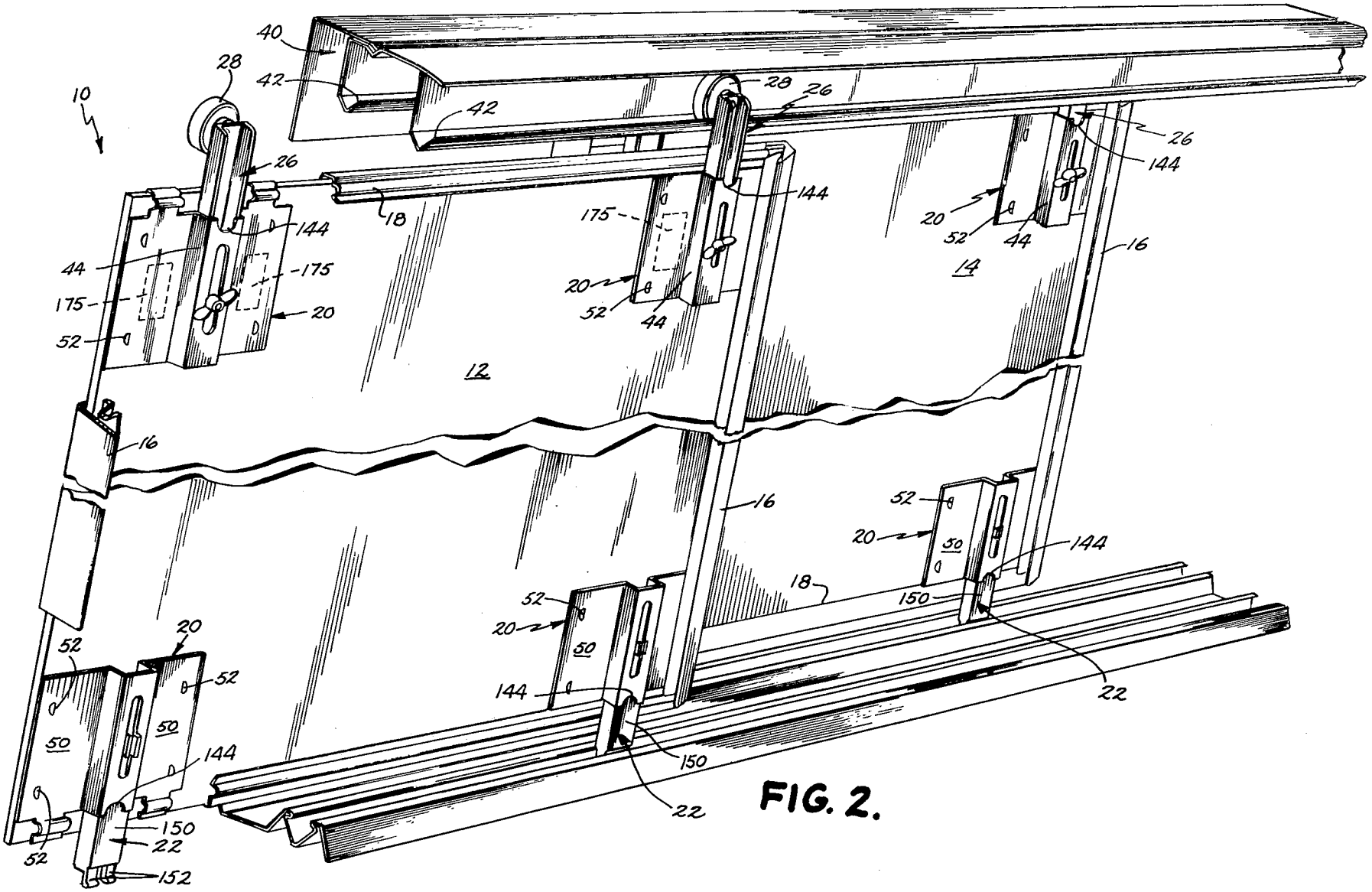
FIG. 2 is a fragmentary, partially sectioned, perspective view of a top roller by-pass door assembly in accordance with the present invention.

A bottom roller, by-pass door assembly including hardware in accordance with the present invention is illustrated in FIG. 1 and generally designated 10. A top roller, by-pass door assembly incorporating hardware in accordance with the present invention is illustrated in FIG. 2 and generally designated 10'. Each of the sliding or by-pass door assemblies 10 and 10' include a pair of rectangular panels 12, 14, stiles 16, trim pieces 18 and corner brackets 20. In the bottom roller configuration illustrated in FIG. 1, the upper corner brackets 20 carry guide members 22 adapted to snap fit and ride within trackways 24 secured to the header of a door. The bottom corner brackets 20 in the embodiment illustrated in FIG. 1 adjustably carry roller assemblies 26. The roller assemblies 26 include rollers 28 which ride in lower trackways 30 positioned at the threshhold of the door opening. With the bottom roller configuration, the upper trackways 24 and the lower trackways 30 are identical. The trackways are fabricated from a single sheet of material as by roll forming or from bulk material as by extrusion and include a generally V-shaped channel 32 having shoulders 34 which define a mouth 36 through which the rollers 28 or the guides 22 extend.

The top roller or hung configuration, illustrated in FIG. 2, includes the same stile members 16, trim pieces 18, corner brackets 20, guides 22 and roller assemblies 26. However, the roller assemblies 26 are reversed from their orientation illustrated in FIG. 1 and the upper trackway 24 of FIG. 1 is replaced by a roller trackway 40 defining a pair of parallel, spaced roller tracks 42 adapted to receive the rollers 28. The lower trackway of the embodiment of FIG. 2 is the same as that in FIG. 1 and the guides 22 are adapted to ride within the channel 32 of the trackway to thereby guide the individual doors in their sliding motion.

Each of the corner brackets 20, as best seen in FIGS. 1, 2, 7, 9 and 15 is identical in configuration and is non-handed. Each of the brackets 20 includes a bracket plate having a central, channel-shaped housing 42. The channel-shaped housing 42 includes side walls 44 and a top wall 46 having a longitudinal, adjustment slot 48 formed therein. Extending outwardly from the lateral edges of the central housing 42 are a pair of wing members or securing means 50. Each of the wing members 50 includes spaced, semi-circular, lanced tabs 52 adjacent the lateral edges thereof. The spaced tabs 52 are formed by a simple lancing operation and are adapted to secure the corner brackets to the stile members, as more fully explained below. Extending from a transverse edge of each bracket are a pair of L-shaped tabs 54. The free leg 56 of the tab 54 engages the transverse edge of the panel 12, as seen in FIGS. 1 and 2, to position the bracket on the panel prior to snap on attachment of the trim pieces. The non-free leg 58 of the tab 54 includes a transverse bead 60. The transverse bead 60 is adapted to cooperate with the trim piece to secure the corner bracket to the panel, as more fully described below.

Figure 3:
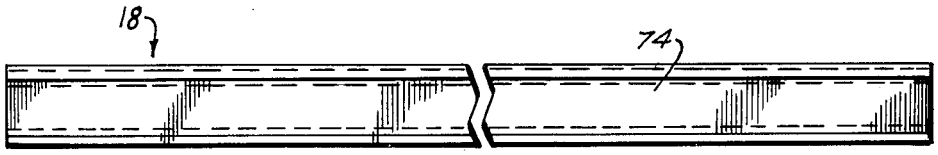
FIG. 3 is a fragmentary, top plan view of a trim member in accordance with the present invention.
Figure 4:
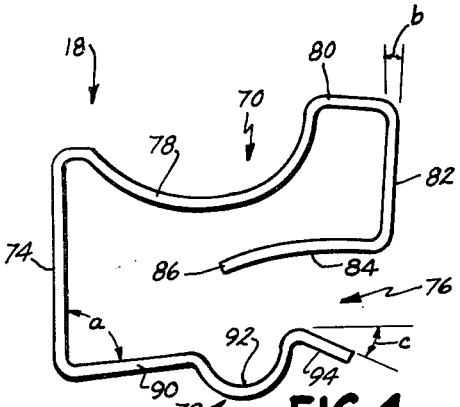
FIG. 4 is an enlarged, end view of the trim member of FIG. 3.

The trim pieces 18 are best seen in FIGS. 3 and 4. As shown therein, each trim piece is fabricated as an elongated, generally channel-shaped member. The trim piece 18 includes a front wall 70, a rear wall 72 and a base wall 74. The walls define a channel 76 adapted to receive panel sections of varying thickness. The front wall 70 includes a generally curved portion 78, a first planar portion 80, a second planar portion 82 directed towards the channel 76 and angled slightly towards the base wall 74, a rear wall 72 and a reverse bent portion 84 which extends into the channel 76. The portion 84 has a generally curved shape in cross section and terminates in a sharp edge 86 which is positioned within the channel. The rear wall 72 includes a first planar portion 90 which joins the base wall 74 at an angle *a*, a longitudinal groove or semi-circular portion 92 and a second planar portion 94. The second planar portion 94 angled with respect to the horizontal at an angle *c*. The second planar portion 82 of the front wall, which in conjunction with the curved portion 84 defines a reverse bent portion, is angled with respect to vertical at angle *b*. The curved portion 84 of the front wall 70 and the rear wall 72 define the mouth of the channel 76. The trim piece is fabricated from a somewhat resilient material such as cold rolled steel and will flex to receive panels of varying thickness. In one existing embodiment, the angle *a* is equal to 84°, the angle *b* is equal to 5° and the angle *c* is equal to 24°. The semi-circular groove 92 of the trim piece, as best seen in FIGS. 1 and 2, snaps over the L-shaped lugs 54 of the corner bracket 20. The bead 60 is captured within the groove 92. In this manner, the trim piece and the brackets are interconnected. Further, the sharp edge 86 of the front wall portion 84 will dig into the panel material when the trim member is snapped over the edge of the panel to thereby resist separation of the trim piece from the panel.

Figure 5:
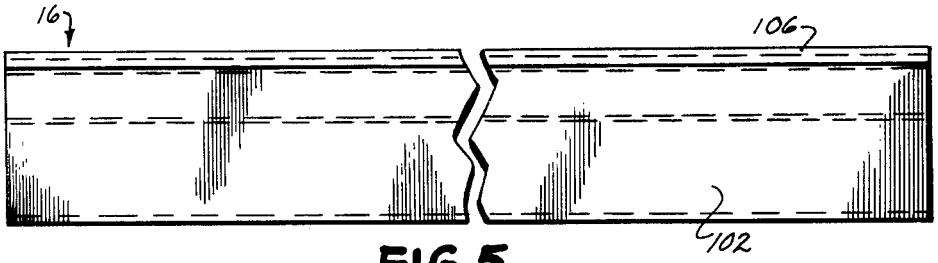
FIG. 5 is a side, elevational view of a stile member in accordance with the present invention.
Figure 6:
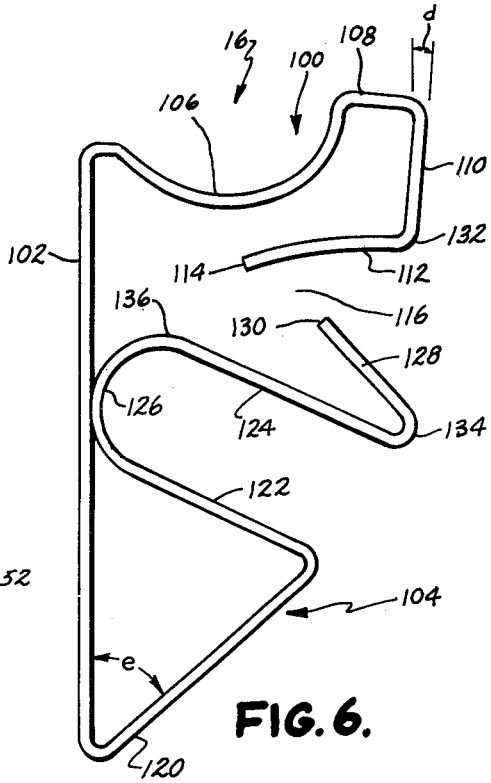
FIG. 6 is an enlarged, end view of the stile member of FIG. 5.

The stile 16 is best seen in FIGS. 5 and 6. As shown therein, the stile is also fabricated from a single piece of material as an elongated member and includes a front wall 100, a side wall 102 and a rear wall 104. The front wall 100 has a curved portion 106, a first planar portion 108, a second planar portion 110 extending towards the rear wall 104 and slightly towards the side wall 102. A generally curved portion 112 extends towards the side wall 102, joins the second planar portion 110 in a generally perpendicular fashion and terminates in a sharp edge 114 which is positioned within the channel 116 of the stile member. The portions 110 and 112 define a generally L-shaped, reverse bent portion.

The front wall 70 of the trim piece and the front wall 100 of the stile member, although dimensioned differently, are provided with the same styling. As a result, the trim piece and the stile member will frame the panel in an aesthetically pleasing fashion. Further, the curved portion 106 and the planar portions 108 and 110 of the front wall define an integral pull handle. This design, therefore, eliminates the need for separate handles which would have to be attached to the panels 12 or 14.

The rear wall 104 is configured to substantially increase the rigidity of the stile and hence the rigidity of the framed panel with a minimum amount of material. Also, the rear wall is configured so that the stile may be easily snapped on the edge of the panel without cocking or camming relative to the panel. As best seen in FIG. 6, the rear wall 104 includes a first planar portion 120 which is integral with the lateral edge of the side wall 102 and defines an angle *e* with the side wall 102. A second planar portion 122 integral with the opposite end of the first portion 120 extends towards the side wall 102. As a result, the first portion 120 and the second portion 122 define, with the side wall 102, a generally triangular shaped box portion in cross section. This triangular shaped portion increases the rigidity of the stile. As a result, thinner panels may be used in the door assembly. This reduces manufacturing and installation costs from present values while still providing a rigid door. The second portion 122 joins with a third portion 124 through a curved portion 126 which contacts the inner surface of the side wall 102. As a result, the portions 122, 124 and 126 define an elongated, generally U-shaped groove, the base of which contacts the inner surface of the side wall 102. The rear wall 104 terminates in a reversely bent, planar portion 128 which extends towards the front wall 100 and the side wall 102. The reversely bent portion 128 also terminates in a sharp edge 130 which is positioned within the channel 116. The curved portion 106 of the front wall 100 and the curved portion 126 of the rear wall 104 increase the flexibility of the front and rear walls so that the stile member will accommodate a fairly wide range of panel thicknesses.

When the stile is snapped over the edge of the panel, the reversely bent portion 128 of the rear wall 104 will flex and snap over the lanced tabs 52 at the lateral edges of each corner bracket 20. In this manner, the brackets 20 are captured and retained by the stile members 16. A stile fabricated in accordance with the present invention is capable of accommodating a wider range of panel thicknesses than that heretofore possible. The triangular box-like structure defined by the rear wall and a side wall gives strength and rigidity to the stile and the resulting panel construction. The sharp edge 114 and the edge 130 of the front and rear wall, respectively, will tend to dig into the panel once it is installed within the channel 116 and thereby prevent separation of the stile from the panel.

When the stile member is snapped onto a panel edge, the panel will be contacted by the integral lateral edge of the portion 112 of the front wall which also defines the lateral edge of the mouth of the channel 116. Also the panel will be engaged by the sharp edges 114, 130, by the curved portion 126 of the rear wall and will abut the inner surface of the side wall 102. The stile therefore, in effect, provides a five-point bearing on the panel which prevents the assembler from getting the stile cocked or twisted with respect to the panel.

The throat of the channel 116 is defined by the lateral edge 132 of the portion 112 and also by the lateral edge 134 of the reversely bent portion 128 of the rear wall 104. The throat therefore gradually decreases in dimension from the mouth of the channel towards the rear wall. This structure guides the stile member onto the panel. In the preferred embodiment, the horizontal distance between the sharp edge 114 and the sharp edge 130 is equal to the horizontal distance between the sharp edge 130 and the lateral edge 132 of the front wall. In other words, the sharp edge 130 of the planar portion 128 of the rear wall terminates spaced from the portion 112 of the front wall and intermediate the lateral edges of the portion 112 of the front wall and generally opposite the longitudinal center line of the front wall reverse bent portion. The horizontal distance from a longitudinal contact line 136 on the curved portion 126 which engages the panel and the sharp edge 114 equals the horizontal distance between the sharp edge 114 and the sharp edge 130. This configuration and dimensioning insures that the stile will be snapped on without cocking or twisting. In an existing embodiment, the angle *e* between the first planar portion 120 of the rear wall and the side wall 102 is approximately 50°. The angle *d* which the second planar portion 110 of the front wall assumes with respect to vertical is approximately 5°. Panels having a thickness of ⅛ inch to ¼ inch may be accommodated.

Both the trim piece and the stile are slot free pieces. Due to this fact and due to the manner by which the trim pieces and the stile capture a corner bracket, these members are readily adapted to frame panels for doors of odd sizes. All that need be done is to straight cut the trim member and the stile member to size. This eliminates the need for any special tools which have heretofore been required to accommodate odd size doors. Anyone who possesses a hacksaw has the ability to fabricate any size by-pass door. The pieces for framing the panel and the corner brackets are completely nonhanded. This fact makes the hardware easier to assemble, reduces manufacturer's costs, and increases productivity. It also reduces the possibility of miscutting or misassembling.

Figure 7:
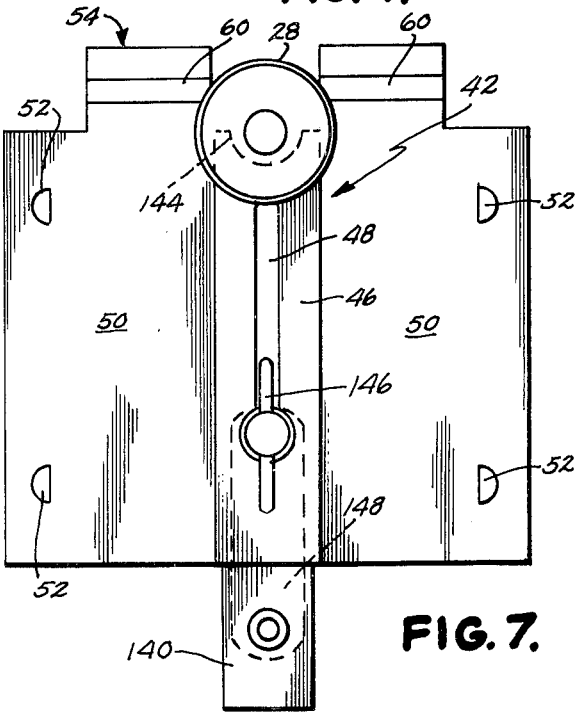
FIG. 7 is a plan view of a corner bracket including a support roller in accordance with the present invention.
Figure 8:
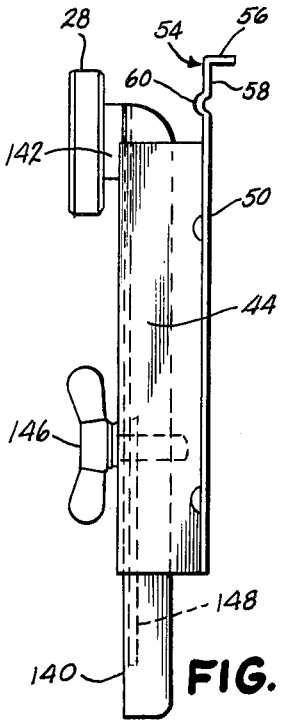
FIG. 8 is a side, elevational view of the bracket and support roller of FIG. 7.

As best seen in FIGS. 7 and 8, each roller assembly includes an elongated, rectangular arm 140 supporting an axle 142 at one end thereof. Rotatably mounted on the axle 142 is a roller 28. The housing 46 at the transverse edge from which the arm 140 extends is notched to assume a semi-circular shape 144. As a result of this notching, the arm 140 may be moved into the housing so that the axle 142 abuts notch 144 to better protect the roller during shipment. The arm is adjustably secured within the slot 48 by a wing nut 146 threadably engaging a weld nut 148 secured to the arm 140. As a result of this arrangement, the door may be adjusted in the track merely by turning the wing nut 146 by hand and sliding the arm 140 relative to the longitudinal slot 48 until the proper position is obtained. As is apparent, from a comparison of FIGS. 1 and 2, when a bottom roller configuration is employed, the roller is reversed from the position assumed when a top roller configuration is employed as in FIG. 2.

As seen in FIGS. 9–14, the guide 22 includes an elongated, generally rectangular guide body 150. Extending from one end of the guide body 150 are a plurality of guide elements 152. Two of the guide elements 152 extend outwardly from the end of the guide body adjacent one surface thereof while the third guide element 152 extends from the end of the guide body adjacent the other surface thereof. The guide elements are all generally parallel to each other and to the uppwer and lower surfaces of the guide body 150. Each guide element is provided with a barbed head 154. The guide elements and the barbed head 154 are dimensioned so that they will snap fit into the trackways 24 or 30 and the barbed heads will engage the undersurface of the shoulders 34 of the trackway. Since the guide elements are spaced transversely of the guide body and hence longitudinally of the trackway, they will guide the door during sliding motion and also prevent inadvertent removal or untracking of the door from the trackway.

Figure 11:
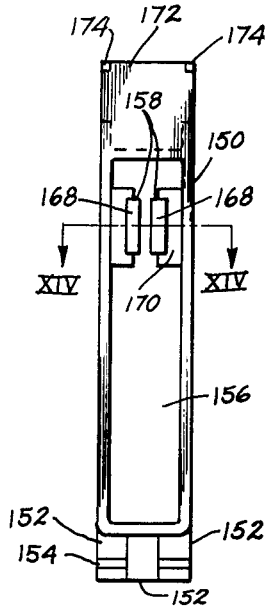
FIG. 11 is a plan view of a guide in accordance with the present invention.
Figure 12:
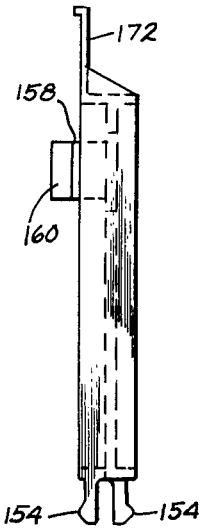
FIG. 12 is a side view of the guide of FIG. 11.
Figure 13:
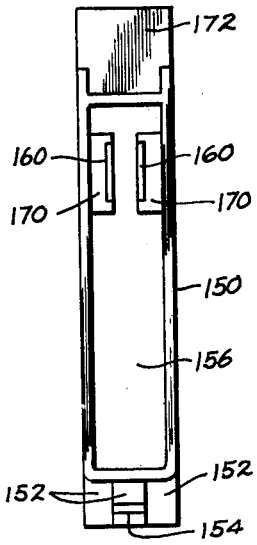
FIG. 13 is a bottom, plan view of the guide of FIG. 11.
Figure 15:
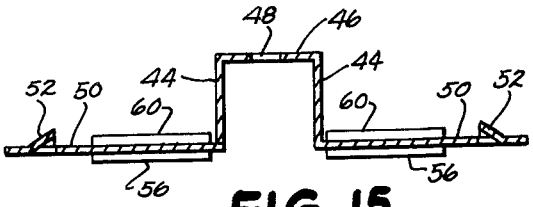
FIG. 15 is a cross-sectional view with the guide removed taken along line XV—XV of FIG. 9.
Figure 14:
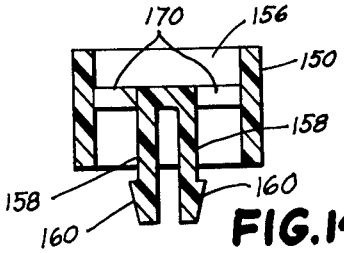
FIG. 14 is a cross-sectional view taken along line XIV—XIV of FIG. 11.

In the preferred embodiment, the guide body is molded as a one-piece, integral member in a simple, two-piece mold. The guide body includes a central web 156. Extending upwardly from one face of the central web 516 are a pair of attachment and securing tabs or lugs 158. The lugs 158 are parallel to each other and also to the lateral sides of the guide body. Each attachment lug includes barbs 160 which extend outwardly towards the lateral edges of the guide body. As seen in FIGS. 11 and 13, the central web 156 defines rectangular apertures 170. These result from the use of a simple two-piece mold which permits forming of the barbed heads without the use of cams in the molding process. The guides are preferably fabricated from a plastic material, such as acetal.

Figure 10:
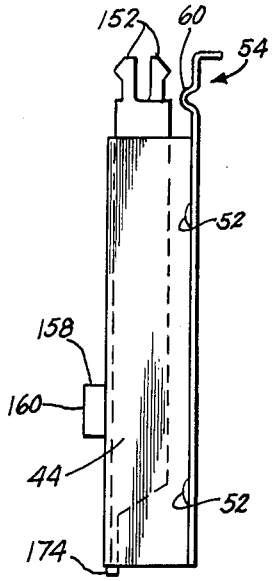
FIG. 10 is a side, elevational view of the corner bracket and guide of FIG. 9.
Figure 9:
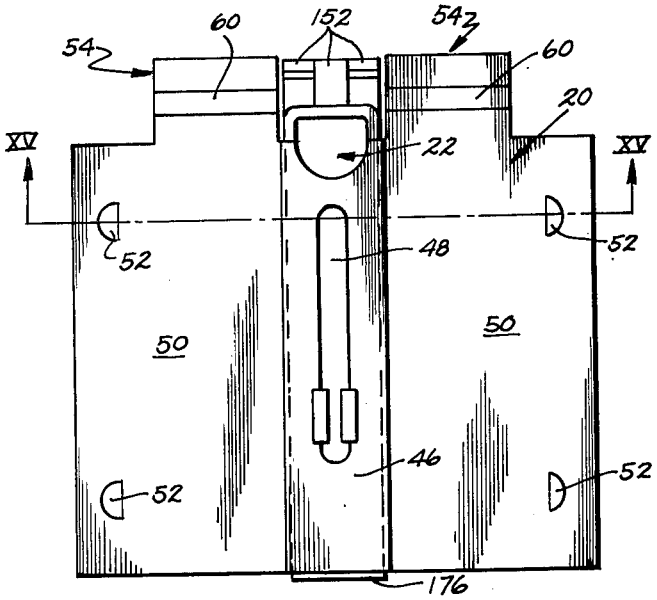
FIG. 9 is a plan view of a corner bracket including a guide member in accordance with the present invention.

Extending from the end of the guide body 150 opposite the guide elements 152 is a cantilevered, planar or tab-like portion 172. Upwardly directed teats 174 are formed at the corners of the tab 172. The guide is secured to a corner bracket 20 by snapping the attachment lugs 158 upwardly through the longitudinal slot 48. The barbs 160 engage the top surface of the central housing and frictionally retain the guide in the housing. As seen in FIGS. 9 and 10, the guide may be slipped within the housing so as to be protected by the bracket during shipment. When in the stored, shipping position, the teats 174 engage the transverse edge 176 of the housing. When the guide is slipped forward to an operating position, the teats 174 on the cantilevered tab 172 will engage the undersurface of the top wall 46 of the housing. The teats are dimensioned to reduce any warble of the guide by biasing the barbs 160 against the top surface of the housing. In this manner, the guide is fairly securely retained within the bracket structure. The attachment lugs 158 permit ready removal of the guide from the bracket without dismounting of the door structure. By squeezing the flexible lugs 158 together they may be pushed inwardly through the slot 48 permitting removal of the guide body from the bracket. This feature substantially increases the ease of replacement of guide elements as well as increasing the ease of assembly of the overall door construction.

ASSEMBLY

In order to assemble a by-pass door as a bottom roller configuration as illustrated in FIG. 1, the guide tracks 24 and 30 are attached to the header and the door threshhold, respectively. Next, the stiles are snapped onto the lateral edges of the panel. The corner brackets 20 are then positioned at the corners of the panel and the lanced tabs 52 are snapped under the edges of the stiles. Next, the trim pieces are snapped on the transverse edges of the panel and over the beaded L-shaped tabs or lugs of the bracket members. The rollers 26 are then inserted in the bottom brackets and the top guides 22 are inserted in the top brackets. In the alternative, the rollers and guides may be installed in the brackets at the point of manufacture. The panel is then positioned in the doorway and the rollers 28 are placed in their respective tracks 30. Next, the guide bodies 150 are pushed upwardly until the guide elements 152 snap into the tracks 24. The wing nuts 146 are then loosened and the roller arm 140 adjusted until the panel is centered in the doorway and plumbed against the door jamb. The bottom roller configuration eliminates the need for a substantial header or trackway which is required for the top roller configuration. This presents a much lower trackway silhouette and much more aesthetically pleasing appearance for the door closure. A fascia 180 may be sandwiched between the top trackway and the door header for aesthetic purposes. However, since in the bottom roller configuration the top and bottom trackways are the same, the fascia may be eliminated.

In the top roller configuration illustrated in FIG. 2, assembly is basically the same except that the top roller trackway 40 is secured to the header of the opening and a fascia 180 is sandwiched between the trackway 40 and the door header.

In the top roller configuration, double coated adhesive tape 175 (FIG. 2) is placed on the back of the brackets. The adhesive tape assists in holding the corner brackets to the panel. The adhesive tape 175 (FIG. 2) prevents slipping of the brackets which must suspend the entire weight of the panel from the upper trackway. When the door is assembled in the bottom roller configuration, the adhesive backing is not required since the free legs 56 of the L-shaped tabs 54 on the brackets bear against the transverse edge of the panel to thereby support the weight. The guides do not support any of the weight of the door.

It can therefore be seen that the unique by-pass door in accordance with the present invention is a totally snap together assembly which is readily adapted to odd door sizes. The triangular box-like structure of the stiles results in a high pressure being exerted on the edge of the panels, rigidifies the structure and also captures the snap on hardware. The overall door may be lighter in weight than that heretofore available. The slide arm for each roller assembly is easily reversed for either top hanging or bottom rolling of the door and in the bottom roller configuration heavy duty operation is provided in that the weight of the door rests on the floor instead of being suspended from a header type track. Door height adjustment may be made by hand and no special tools are required. The guides and the rollers may initially be set behind the edge of the brackets to prevent damage in transport which also reduces the packaging requirements. The rollers and guides are easily replaceable without tools and without removing the door from the opening. The stiles, trim pieces, corner brackets, rollers, guides and upper and lower trackways may be packaged and sold as a kit. The purchaser selects the type and size of rectangular panel to suit his particular needs for use with the kit hardware.

In view of the foregoing description, those of ordinary skill in the art will probably envision certain modifications which would not depart from the concepts disclosed herein. For example, the guides could be fabricated with only a pair of guide elements extending from the end thereof. Whether two or three elements are employed is basically the result of the type of mold used in fabrication. As expressly intended, therefore, the above description should be considered as that of the preferred embodiments only. The true spirit and scope of the present invention will be determined by reference to the appended claims.

The embodiments of the invention in which an exclusive property or privilege is claimed are defined as follows.

1. A door construction of the type having a pair of stile members and a pair of trim members adapted to frame a rectangular panel and a plurality of corner brackets held by said stile members and said trim members at the corners defined by said members when they are positioned on said panel at right angles to each other, the improvement comprising: said stile members each being an elongated one-piece, slot-free member having spaced front and rear walls joined by a side wall to define a panel receiving channel, said rear wall including a reversely bent portion extending towards said side wall and into said channel; said trim members each including a front wall and a rear wall joined by a base wall to define a panel receiving channel, said rear wall including a first planar portion angled towards said first wall, a longitudinally extending, outwardly directed grooved portion and a second planar portion angled away from said front wall and defining a lateral edge of said channel and wherein each of said brackets comprises:

a one-piece bracket plate having a centrally positioned channel shaped housing, said housing including side walls and an outer base wall; said outer base wall defining a longitudinally extending slot, said bracket plate adjacent the lateral edges thereof including spaced, outwardly projecting tabs, said rear wall reversely bent portion of said stile members being snapped over said tabs to capture said brackets at each of the corners defined by one of said stile members and one of said trim members, and wherein each of said brackets further includes an L-shaped tab extending from a transverse edge thereof adjacent said housing, said tab including a transverse bead and said trim member snapping over said bead and capturing said bead in said grooved portion.

2. A door construction as defined by claim 1 further including a pair of guide means one for each corner bracket at one end of said panel, each of said guide means comprising:

a one-piece, elongated member having at least two guide elements extending therefrom, each guide element having an outwardly directed barb adapted to engage a track, said member further including a pair of resilient, spaced, parallel attachment and removal lugs extending outwardly from said member, each of said lugs having longitudinal securement barbs extending towards the lateral edges of said member, said attachment and removal lugs dimensioned to snap fit into said bracket longitudinal slot, said guide being removable from said slots by pressing said lugs together.

3. A door construction as defined by claim 1 further including a pair of roller means, one for each corner bracket at one end of said panel, each roller means comprising:

an arm mounted in said channel for sliding movement lengthwise thereof;

a roller rotatably mounted on said arm; and manually adjustable attachment means extending through the slot and into said bracket for adjustably securing said arm to said bracket within said housing.

4. A door construction as defined by claim 3 wherein said attachment means comprises a winged threaded fastener.

5. A door construction as defined by claim 3 further including a pair of guide means for each corner bracket at one end of said panel, each of said guide means comprising:

a one-piece, elongated member having at least two guide elements extending therefrom, each guide element having an outwardly directed barb adapted to engage a track, said member further including a pair of resilient, spaced, parallel attachment and removal lugs extending outwardly from said member, each of said lugs having longitudinal securement barbs extending towards the lateral edges of said member, said lugs dimensioned to snap fit into said bracket longitudinal slot, said guide being removable from said slots by pressing said lugs together.

6. A door construction as defined by claim 5 wherein said rear wall of each of said stile members includes a first portion extending towards said front wall from the lateral edge of said side wall and joined to said reverse bent portion to thereby define in cross section a triangular shaped box portion.

7. A door construction as defined by claim 6 wherein said first portion of said rear wall of each of said stile members is joined to said reverse bent portion by an elongated portion having a generally U-shape in cross section, the base of said U-shaped portion contacting the side wall.

8. A door construction as defined by claim 7 wherein said front wall of said stile includes an L-shaped portion having one leg extending into said channel and towards said side wall.

9. A door construction as defined by claim 8 wherein said one leg of said L-shaped portion of said stile is generally curved and terminates in a longitudinally extending sharp edge disposed within said channel.

10. A door construction as defined by claim 9 wherein said trim member front wall includes a reverse bent portion extending into said trim member channel and towards said base wall.

11. A stile for receiving one edge of a rectangular panel, comprising:

an elongated member defining a panel receiving and engaging channel having a mouth opening along the length of said member, said member including a front wall, a side wall and a rear wall, said front wall including a reversely bent portion defining one longitudinal edge of said mouth and terminating in a sharp edge positioned within said channel, said rear wall including a first portion extending towards said front wall from the lateral edge of said side wall, said first portion terminating in a lateral edge, a second portion angled with respect to said first portion and extending towards said side wall from the lateral edge of said first portion to thereby define a triangular box portion, a third portion integral with said second portion and angled away from said front wall and a fourth reversely bent portion angled towards said front wall and said side wall to define another lateral edge of said mouth and said fourth portion terminating in a sharp edge positioned within said channel.

12. A stile as defined by claim 11 wherein said second and third portions of said rear wall define a longitudinal groove which is generally U-shaped in cross section, the base of said U-shaped groove contacting the inner surface of said side wall.

13. A stile as defined by claim 12 wherein said front wall includes a curved portion extending into said channel to increase the flexibility of said front wall.

14. A stile as defined by claim 13 wherein said front wall defines a pull handle.

15. A stile as defined by claim 13 wherein said sharp edge of said fourth portion of said rear wall is positioned spaced from said reverse bent portion of said front wall and intermediate the edges of said reverse bent front wall portion.

16. A stile as defined by claim 15 wherein said sharp edge of said rear wall is positioned generally opposite the longitudinal center line of said reverse bent portion of said front wall.

17. A stile as defined by claim 16 wherein said front wall includes a second planar portion integral with said first curved portion to define therewith a pull handle.

18. A stile as defined by claim 17 wherein said reverse bent portion of said front wall comprises:

a third planar portion generally perpendicular with said second planar portion and extending slightly towards said side wall and into said channel; and a fourth gently curved portion extending generally perpendicular to said third planar portion towards said side wall, said walls being dimensioned so that a panel received in said channel abuts said side wall and is contacted by the lateral edge of said mouth defined by said front wall, the sharp edges of said front wall and said rear wall and along a longitudinal contact line on said third portion of said rear wall.

19. A stile as defined by claim 18 wherein the horizontal distance between said longitudinal contact line on said third portion of said rear wall and said sharp edge of said front wall is substantially equal to the horizontal distance between the sharp edges of said front and rear walls.

20. A non-handed corner bracket and guide adapted to be held to a corner of a door construction by a stile member and a trim member arranged at right angles to each other and snapped over adjacent edges of a panel, the guide adapted to cooperate with a track having a shouldered mouth, said bracket and guide comprising:

a bracket plate including a central channel-shaped portion having spaced side walls joined by a top wall, said top wall having a longitudinal slot and said plate further having outwardly extending portions integral with the lateral edges of said side walls opposite said top wall; each of said outwardly extending portions having lanced tabs adjacent their free ends adapted to be captured by the snap on stile; and a one-piece guide body having at least two, resilient, barbed guide elements extending from one end and dimensioned to be insertable within the mouth of said track, said body further including a pair of spaced, resilient lugs extending from a face thereof, each lug including a barb extending toward the lateral edge of said body, said lugs and said lug barbs dimensioned to snap into said top wall slot from within said channel-shaped portion so that said guide body is adjustably mounted to said bracket plate and may be removed from said plate without total removal of said door from the opening.

21. A non-handed corner bracket and guide as defined by claim 20 wherein said guide body further includes a longitudinal planar member extending from said body end opposite said guide elements and a teat extending from said planar member towards the inner surface of said bracket plate top wall, said teat dimensioned to engage said top wall and increase the frictional contact of said lug barbs with the outer surface of said top wall.

22. A non-handed corner bracket and guide as defined by claim 21 wherein said bracket plate further includes an L-shaped tab extending from a transverse edge thereof, the free leg of said L-shaped tab adapted to engage the edge of the panel and the remaining leg including a transverse bead adapted to be captured by the trim member.

23. A corner bracket for use in a sliding door construction of the type having a stile snapped on an edge of a panel and a trim piece snapped on another edge of the panel so as to be perpendicular to said stile, said trim piece including a wall defining an outwardly directed groove, said stile including a reverse bent portion, said corner bracket comprising:

a one-piece plate defining a centrally positioned channel-shaped housing having spaced side walls joined by a top wall, said top wall having an elongated slot therein for adjustably receiving a roller assembly or a guide; a pair of wing members extending outwardly from said housing side wall; at least one upstruck tab adjacent the free lateral edge of each of said wing members, whereby the reverse bent portion of a stile may snap over said tabs; and a pair of L-shaped tabs, one extending outwardly from a transverse edge of each of said wing members, the legs of said L-shaped tabs joined to said wing each defining a bead, whereby a trim piece may snap over said L-shaped tabs and capture said beads within the groove of the trim piece.

24. A corner bracket for use in a sliding door construction of the type having a stile snapped on an edge of a panel and a trim piece snapped on another edge of the panel so as to be perpendicular to said stile, said trim piece including a wall defining an outwardly directed groove, said stile including a reverse bent portion, said corner bracket comprising:

a one-piece plate defining a pair of outwardly extending wing members;

means on each of said wing members for snapping under the reverse bent portion of a stile member so that said bracket may be held by the stile member; and a pair of L-shaped tabs, one extending outwardly from a transverse edge of each of said wing members, the leg of said L-shaped tab joined to said wing member defining a bead, whereby a trim piece may snap over said L-shaped tabs and capture said beads within the groove of the trim piece.

25. A corner bracket as defined by claim 24 further including housing means on said plate for adjustably receiving a roller assembly or a guide.

26. A corner bracket as defined by claim 25 wherein said snapping means comprises an offset projection.

27. A corner bracket as defined by claim 26 wherein said housing means comprises a channel-shaped member having an elongated slot therein for adjustably receiving said roller assembly or said guide.

28. A guide for a sliding door construction and usable with a corner bracket of the type including a housing having an elongated slot through a wall thereof, said guide comprising:

an elongated, molded plastic body;

at least two guide elements extending from one end of said body and integral therewith;

a pair of flexible, spaced parallel attachment lugs extending from a surface of said body, each of said lugs being integral with said body and having barbs extending towards the lateral edges of said surface and longitudinally of said body, said lugs and said barbs dimensioned to snap through the bracket housing slot to thereby frictionally secure said guide to said bracket;

a flexible, cantilevered tab extending from the end of said body opposite said guide elements; and a teat integral with the upper surface of said cantilvered tab and adapted to frictionally engage the bracket housing and bias the lug barbs into engagement with the bracket housing.

* * * * *

UNITED STATES PATENT AND TRADEMARK OFFICE

CERTIFICATE OF CORRECTION

PATENT NO. : 4,123,874

DATED : November 7, 1978

INVENTOR(S) : Victor J. Scott

It is certified that error appears in the above-identified patent and that said Letters Patent are hereby corrected as shown below:

Column 2, line 36:

"which" should be --while--;

Column 4, line 33:

After "94" second occurrence insert --is--;

Signed and Sealed this

*Eighteenth* Day of *September 1979*

[SEAL]

*Attest:*

*Attesting Officer*

LUTRELLE F. PARKER

*Acting Commissioner of Patents and Trademarks*